United States Patent [19]

Hailey

[11] Patent Number: 4,615,208

[45] Date of Patent: Oct. 7, 1986

[54] HYDRAULIC PRESS FRAME

[76] Inventor: Robert W. Hailey, 2030-229 Beverly Plz., Long Beach, Calif. 90815

[21] Appl. No.: 585,915

[22] Filed: Mar. 2, 1984

[51] Int. Cl.[4] ..... B21D 37/12

[52] U.S. Cl. ..... 72/455; 72/456; 72/453.01; 100/214

[58] Field of Search ..... 72/455, 456, 453.01, 72/389, 481, 482, 448, 705; 100/214, 295; 92/169 R; 403/356, 319; 144/346, 344

[56] References Cited

U.S. PATENT DOCUMENTS

| | | | |
|---|---|---|---|
| 545,758 | 9/1895 | Aiken | 72/455 |
| 2,416,058 | 2/1947 | Mangnall | 100/214 |
| 3,191,238 | 6/1965 | Olson | 144/346 |
| 3,346,922 | 10/1967 | Brayman et al. | 100/214 |
| 3,356,496 | 12/1967 | Hailey . | |
| 3,359,618 | 12/1967 | Murphy | 100/214 |
| 3,479,856 | 11/1969 | Boggio et al. | 72/455 |
| 3,689,259 | 9/1972 | Hailey | 419/48 |
| 3,919,877 | 11/1975 | Netta | 72/456 |
| 4,008,659 | 2/1977 | Trolle | 100/214 |
| 4,476,780 | 10/1984 | Bunch | 100/214 |

FOREIGN PATENT DOCUMENTS

| | | | |
|---|---|---|---|
| 1401193 | 4/1965 | France | 100/214 |

*Primary Examiner*—Francis S. Husar
*Assistant Examiner*—David B. Jones
*Attorney, Agent, or Firm*—William W. Haefliger

[57] ABSTRACT

A hydraulic press construction uses multiple alternating plates for the press frame sides and ends, and has joints which provide exceptional strength, high safety factors and a rigid frame for high tonnage applications. The joints function to utilize the full shear load capacity of the multiple adjoining faces of the plates in the joint sections. Multiple tensioned shear rods and/or high strength adhesive join the plates together at joint locations, and keys or tongue and groove configurations may be employed in the joints. These elements provide press joints that are rigid and that have high strength. They give the press frame a high resistance to deflection and distortion under load, as well as the capability for precision operations at press loads up to thousands of tons. A special hydraulic cylinder for the press also is described.

10 Claims, 12 Drawing Figures

HYDRAULIC PRESS FRAME

BACKGROUND OF THE INVENTION

This invention relates generally to presses, and more particularly to a press affording multiple advantages in construction and operation.

Prior presses were characterized by bulky, oversize construction, excessive cost and difficult fabrication assembly and installation, and were not sufficiently adapted to precision and fast operation, particularly for use in consolidating powder metallurgy products.

SUMMARY OF THE INVENTION

It is a major object of the invention to provide an improved press construction overcoming the above as well as other problems and difficulties. Basically, the press comprises:

(a) dimensionally longitudinally extending frame means and (b) longitudinally spaced transverse platen structures, at least one of said platen structures including multiple plates with surfaces defining generally parallel planes which are parallel to said longitudinal dimension.

As will be seen, the other platen may also include multiple metallic plates with surfaces defining generally parallel platens which are parallel to said longitudinal dimension; and the frame means may comprise multiple longitudinal frame members, said platen structure plates having portions extending between said frame members in alternating relation therewith, and said plate portions connected with said frame members. The frame and platen members may advantageously comprise parallel metallic plates; and side plates and end pressure distribution plates may be provided to prevent warping and twisting of the frame and to interfit the frame and platen plates, as via tongue and groove elements. Load transmitting means may comprise one or more cylinders and associated plungers, and the cylinder or cylinders may have multiwalled construction, as will appear.

The invention is further characterized by the following advantages:

a. The press uses frame materials readily available at reasonable cost.
b. The press uses press cylinders designed for convenient fabrication, ready availability and reasonable cost.
c. Modular construction simplifies fabrication, assembly.
d. Compact design simplifies installation.
e. Basic design is adaptable to various press sizes.
f. Utilizes mill shapes that require minimum machining.
g. Provides for precise alignment and relative position of frame members and pressure cylinder and tooling.
h. Provides for strong, solid construction that will maintain precision of alignment of the piston during each pressing stroke and relative to tooling.
i. The press construction affords a more uniform distribution of loading against platen members.

Further, shear members are provided in the joint areas of the frame plates by grooving the platen members parallel to the top and bottom edges on the end surfaces, and grooving the side members perpendicular to their longitudinal axes at the joint surfaces, with the grooves designed so that the channels and ribs formed by the grooves in the platen members will fit over and into the ribs and channels of the side members when they are mated together at the joint surfaces, to provide the required shear strength in the joint.

Further, grooves may be provided in the platen members and formed to exactly align with the grooves in the side members at their mating surfaces, so that when the platen and side members are brought together at the joint areas, metal keys can be inserted in the grooves to act as shear members, with means as described to hold the frame plates together.

These and other objects and advantages of the invention, as well as the details of an illustrative embodiment, will be more fully understood from the following description and drawings, in which:

DRAWING DESCRIPTION

DETAILED DESCRIPTION

Figure 1:
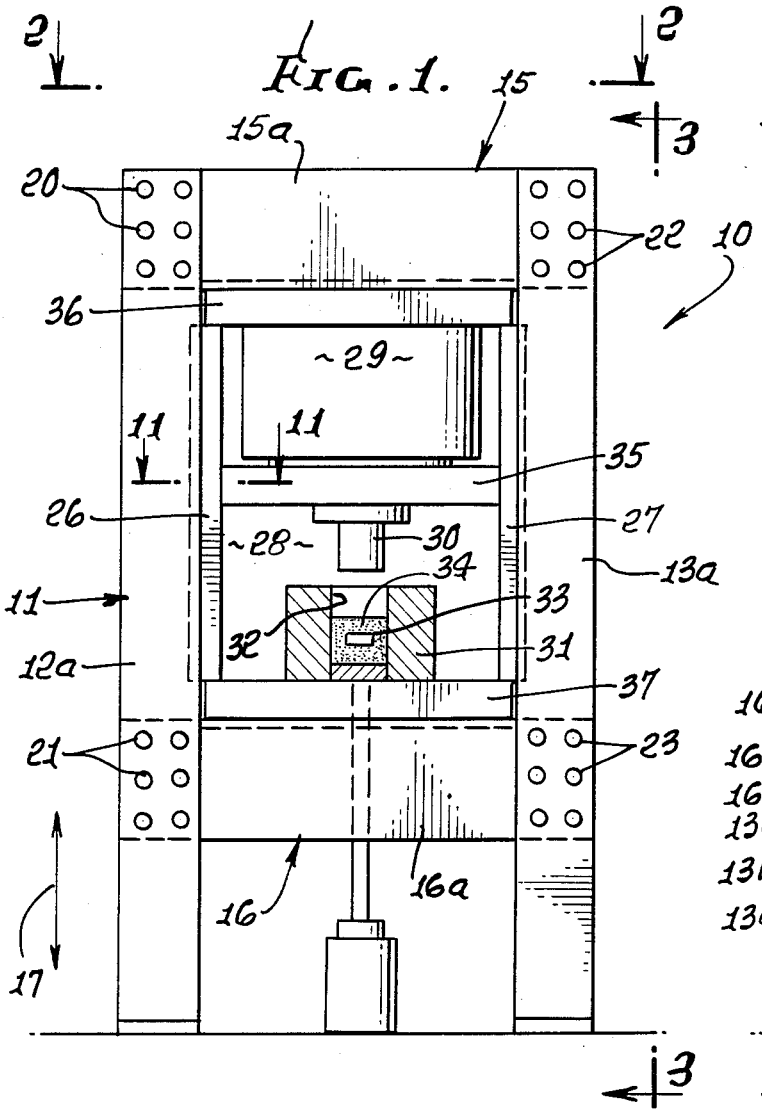
FIG. 1 is a front elevation showing apparatus incorporating the invention.
Figure 3:
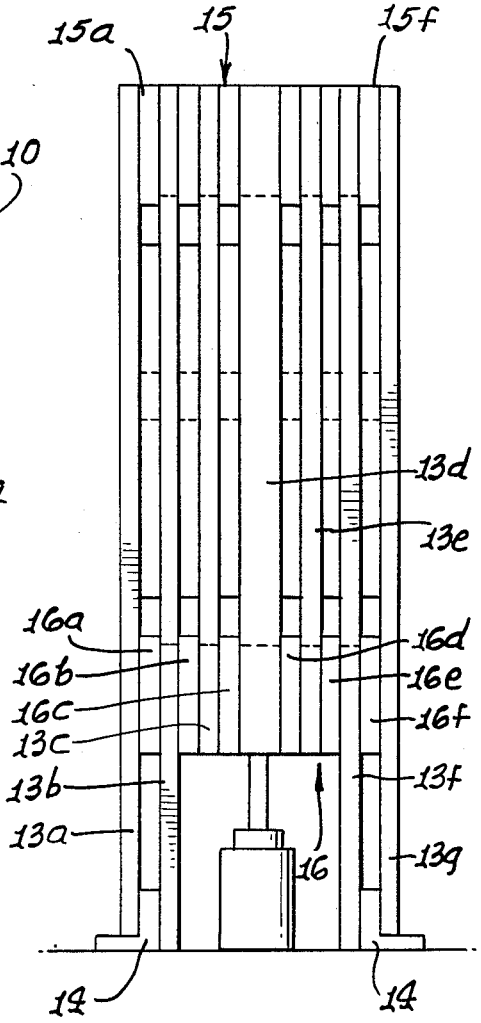
FIG. 3 is a side elevation on lines 3—3 of FIG. 1.
Figure 2:
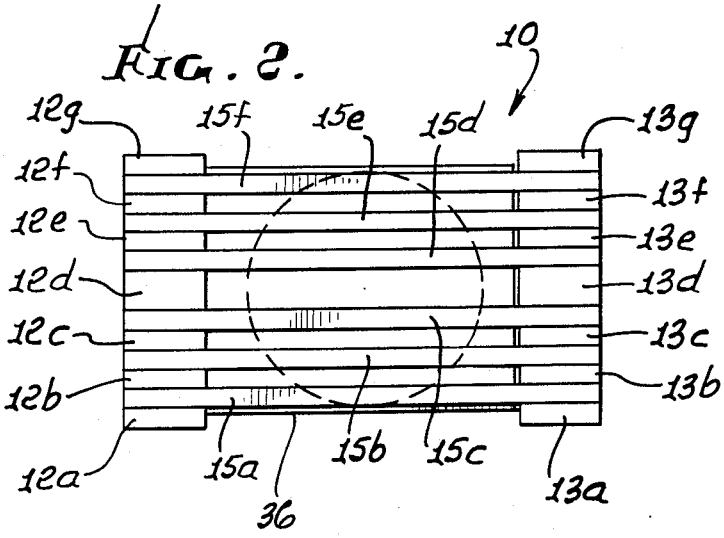
FIG. 2 is a top plan view on lines 2—2 of FIG. 1.
Figure 4:
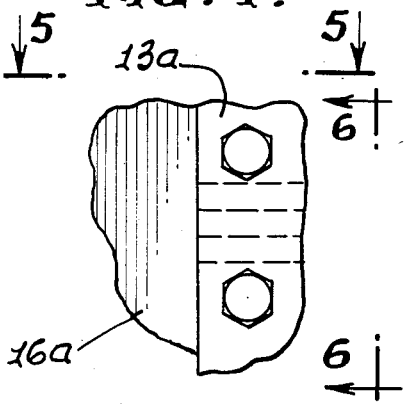
FIG. 4 is an enlarged fragmentary front elevation of a platen and side member connection.

In FIGS. 1-3, the press 10 incorporates longitudinally extending frame means 11 comprising multiple longitudinal frame members, certain of which are at one side of the press (see members 12*a*–12*g*), and others of which are at the opposite side of the press (see member 13*a*–13*g*). Thus, there are left and right groups of frame members. As is clear from FIGS. 1 and 3, pairs of the members as at 12*a* and 12*b*, 13*a* and 13*b*, 12*f* and 12*g*, and 13*f* and 13*g*, are at the corners of the press and extend downwardly to connect to L-shaped footings 14, to support the press. The members comprise heavy duty plates, as for example steel plates one to two inches thick, and are spaced apart, as shown. The longitudinal direction may typically be vertical or horizontal.

The press also incorporates longitudinally spaced platen structures, as at 15 and 16, and at least one of such structures, but preferably both, includes multiple metallic plates with surfaces defining parallel planes which are parallel to the longitudinal dimension indicated by arrow 17. See for example multiple parallel plates 15*a*–15*f* in FIG. 2; and parallel plates 16*a*–16*f*, in FIG. 3.

Portions of the platen plates extend between the frame members in alternating relation therewith, as shown, and are connected therewith as by connectors indicated at 20, 21, 22 and 23. Thus the connectors extend through the plate portion of the frame members at left longitudinally spaced connector locations 20 and 21, and at right longitudinally spaced connector locations 22 an 23. All of the frame members and the plates may advantageously comprise parallel metal plates, as for example steel plates. Adhesives such as epoxies may be used to bond the mating plate surfaces together, resisting warpage and increasing joint strength.

Figure 5:
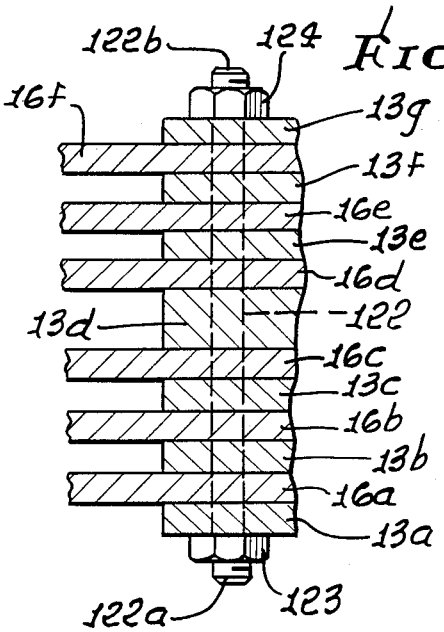
FIG. 5 is a top plan view on lines 5—5 of FIG. 4, without detailing tongues and grooves.

FIG. 5 shows a representative connector comprising a shear rod 122 having opposite threaded ends 122*a* and 122*b*, and tightening nuts 123 and 124 on such ends to clamp the platen and frame members therebetween, placing the rod in tension. Holes are drilled in the platen and side frame members at joint areas for exact alignment, and the rods are inserted into the holes, with close fit, at assembly, shrink fitting being one mode of connection. The shear rods provide shear strength at the joints under press load.

Also shown in FIGS. 1–3 are left and right side plates 26 and 27 interfitting the frame member plates and facing one another across the press space 28 in which are located the press load transmitting means such as cylinder 29, plunger 30, and die 31. The latter may, for example, contain a cavity 32 in which is located a preformed, metallic powder part 33 embedded in ceramic grain 34 to be compressed by the plunger to consolidate the part. See U.S. Pat. No. 3,689.259.

A transverse frame member 35 extends between side plates 26 and 27, and is connected to the piston in cylinder 29. Pressure distribution plates 36 and 37 interfit the upper and lower platen plates at the upper and lower ends of space 28, the load transmitting means including cylinder 29, plunger 30 and die 31 located between plates 36 and 37.

Figure 11:
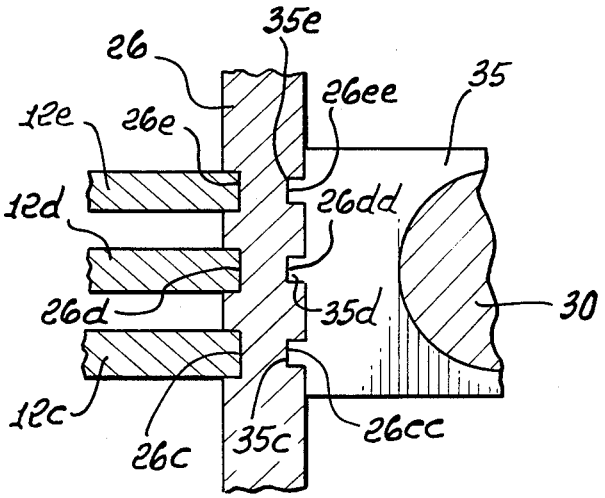
FIG. 11 is a fragmentary section on lines 11—11 of FIG. 1.

FIG. 11 shows the manner in which side plate 26 interfits plate 35 and frame members 12*c*–12*e*. Thus, member 26 may be notched as at 26*c*, 26*d* and 26*e* to receive plates 12*c*–12*e*, respectively, and may be notched at 26*cc*, 26*dd* and 26*ee* to receive tongues 35*c*–35*e* on the member 35. Member 35 moves longitudinally with the plunger 30, to guide same and maintain it precisely aligned with the cavity 32, during plunger movement. Thus the tongue and groove interfit of member 35 with the side members 26 and 27 facilitates precision guidance of the plunger, as during heavy press load transmission. Plates 36 and 37 interfit the plates of platens 15 and 16.

Figure 6:
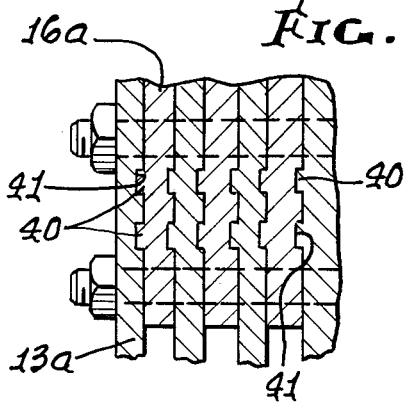
FIG. 6 is a side elevation on lines 6—6 of FIG. 4.

FIG. 6 shows a modification, in which the platen plates and frame members have transverse tongue and groove interfits at 40. Key connection may be used in FIG. 6 at 41, as for example as seen in FIG. 12.

Figure 12:
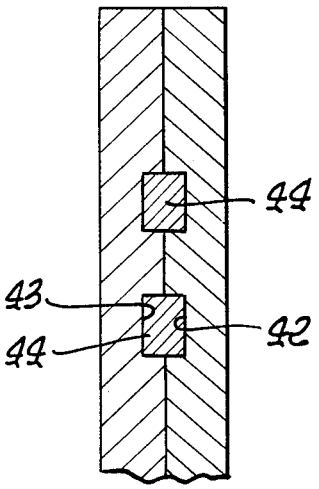
FIG. 12 is a modification.

FIG. 12 shows a further modification in which both the platen and frame members are grooved, as at 42 and 43, and transverse metal keys 44 are inserted in such grooves, to closely fit same. This construction provides a simple form of high strength joint.

Figure 7:
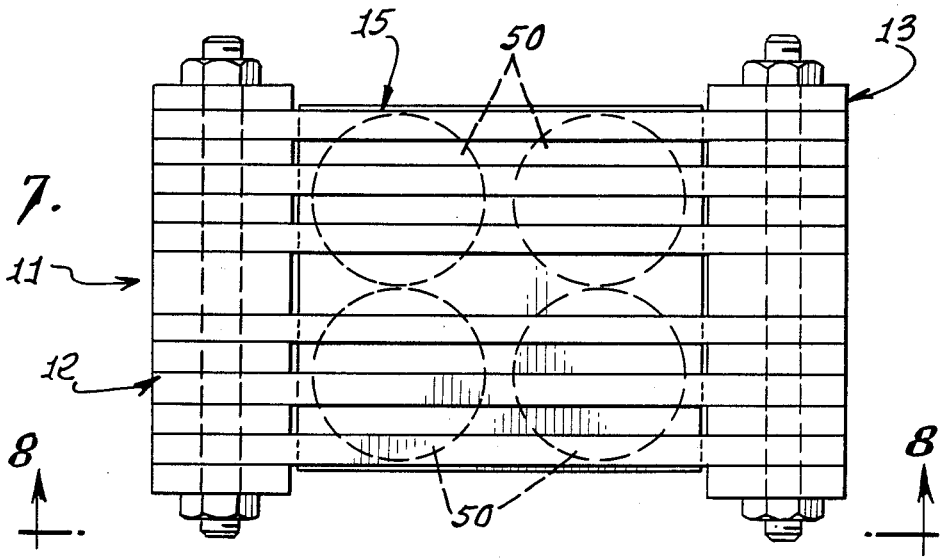
FIG. 7 is a top plan view of modified press apparatus.
Figure 8:
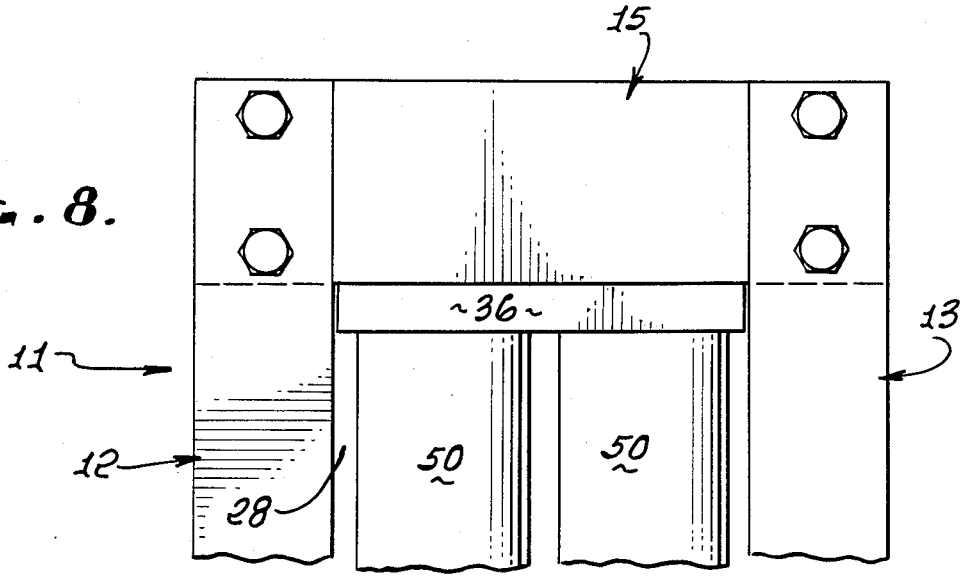
FIG. 8 is a fragmentary front elevation on lines 8—8 of FIG. 7.

FIGS. 7 and 8 show a modification in which multiple cylinders 50 and associated plungers are employed in the region 28 between the frame members, and between the upper and lower platens.

Figure 9:
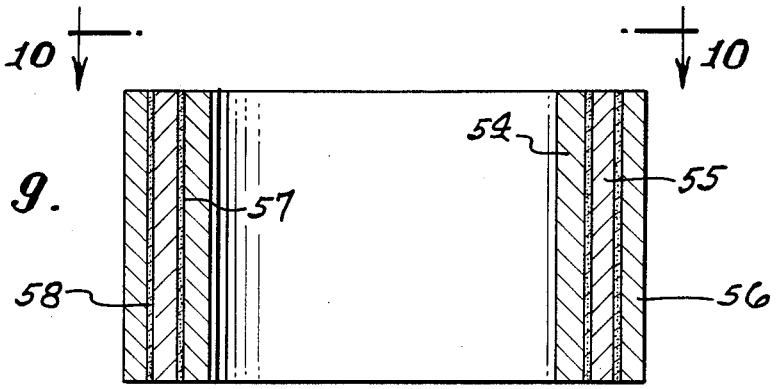
FIG. 9 is an elevation, in section, through a press cylinder.
Figure 10:
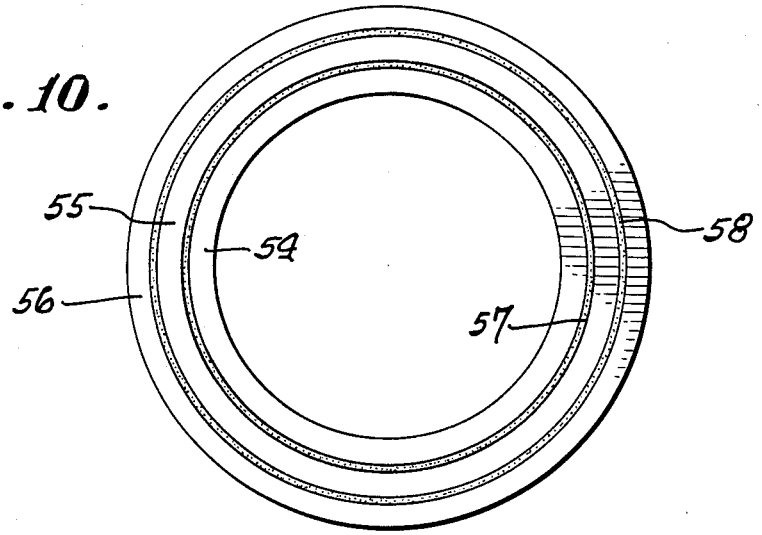
FIG. 10 is a top plan view on line 10—10 of FIG. 9.

FIGS. 9 and 10 show an improved pressure cylinder construction, having multi-layered steel walls formed by concentric cylinders 54–56. Elastomer or rubber or plastic layers 57 and 58 are provided between such walls, to provide improved stress gredients across the multi-layered wall, and increased resistance to fatigue. A typical elastomer is urethane rubber.

The invention affords the following additional advantages:

a. Larger press sizes are made possible,
b. Quiet operation,
c. Fast acting,
d. Minimum platen deflection,
e. Precision stroke action,
f. Good accessibility for tooling,
g. Simple, strong, stable construction,
h. Utilizes readily available materials,
i. Designed for long life,
j. Designed for fabrication with short lead times,
k. Much lower cost than with prior presses of equivalent load cavity.
l. As used in the metal powder consolidation process, the invention provides a primary tool for pressing powders to preform shape, consolidating the preform to a fully density shape, and precision sizing to final form.

I claim:

1. In a press, the combination comprising:

(a) dimensionally longitudinally extending frame means, (b) longitudinally spaced platen structures connected with said frame means, at least one of said platen structures including multiple metallic plates with surfaces defining generally parallel planes which are parallel to said longitudinal dimension, (c) there being another of said platen structures which is longitudinally spaced from said one platen structure, and which also includes multiple metallic plates with surfaces defining generally parallel planes which are parallel to said longitudinally dimension, (d) said frame means comprising left and right groups of multiple longitudinal frame members, the plates of each of said longitudinally spaced platen structures having left and right portions extending between said frame members of said left and right groups, respectively, and in alternating relation with said frame members, (e) and multiple connectors extending through the frame members and through said platen plate portions and surfaces at each of at least four locations, two of which are longitudinally spaced left locations, and two of which are longitudinally spaced right locations, said multiple connectors forcibly clamping said frame members to said platen plate portions, (f) said platen plate portions and said frame members having tongue and groove interfits, (g) and pressure distribution plates each having interfits with said platen structure plates and which face one another longitudinally, and press load transmitting means located longitudinally between said pressure distribution plates, (h) said load transmitting means comprising plunger and cylinder means, (i) and including left and right side plates interfitting said frame member plates and facing one another, and said press load transmitting means located between said said plates and having sliding tongue and groove interfit therewith.

2. The combination of claim 1 including adhesive bonding said frame members to said platen plate surfaces at each of said four locations.

3. The combination of claim 1 wherein said frame means comprises multiple longitudinal frame members, said platen structure plates having portions extending between said frame members in alternating relation therewith.

4. The combination of claim 1 wherein said frame members comprise metal plates with surfaces defining generally parallel planes which extend longitudinally.

5. The combination of claim 2 wherein said frame members comprise metal plates with surfaces defining generally parallel planes which extend longitudinally.

6. The combination of claim 1 wherein said longitudinal dimension is vertical, and said platens extend transversely generally horizontally.

7. The combination of claim 1 wherein said longitudinal dimension is horizontal and said plates extend vertically.

8. The combination of claim 1 in which the plate portions and frame members have opposed grooves, and including keys closely fitted in said grooves.

9. The combination of claim 1 wherein said cylinder means has multiple walls, and elastically deformable layers between said walls.

10. The combination of claim 1 including means to contain a metal powder pre-form, and media in said means to transmit pressure from the plunger to the powder pre-form to compact same.

* * * * *